United States Patent [19]

Jovin

[11] 4,043,232

[45] Aug. 23, 1977

[54] AUTOMATIC CUTTING MACHINE FOR CONTINUOUS TAPES

[75] Inventor: Eudor Louis Jovin, Newport News, Va.

[73] Assignee: Coats & Clark, Inc., Stamford, Conn.

[21] Appl. No.: 715,843

[22] Filed: Aug. 19, 1976

[51] Int. Cl.[2] ..... B26D 5/28; B26D 5/30

[52] U.S. Cl. ..... 83/13; 83/210; 83/362; 83/364; 83/365; 83/371; 83/921

[58] Field of Search ..... 83/209, 210, 362, 364, 83/365, 371, 921

[56] References Cited

U.S. PATENT DOCUMENTS

| | | | |
|---|---|---|---|
| 2,754,908 | 7/1956 | Proud | 83/210 X |
| 3,137,190 | 6/1964 | Mosher et al. | 83/210 |
| 3,376,772 | 4/1968 | Langwell | 83/210 X |
| 3,616,718 | 11/1971 | Di Giulio et al. | 83/210 |

*Primary Examiner*—Willie G. Abercrombie
*Attorney, Agent, or Firm*—Burgess, Ryan and Wayne

[57] ABSTRACT

In an automatic machine for cutting zippers from a common zipper tape, feed rollers are positioned to direct the common tape to the cutter. The sliders on the tape are detected by a photoelectric detector upstream of the feed rollers, in order to develop a signal of determined duration for enabling a bottom stop detector positioned upstream of the slide detector. A delay device is provided to actuate the cutter a determined time following detection of a bottom stop by the stop detector.

12 Claims, 4 Drawing Figures

AUTOMATIC CUTTING MACHINE FOR CONTINUOUS TAPES

This invention relates to a method and apparatus for cutting continuous tapes to determine the lengths, wherein the tapes have distinguishable locations of first and second tapes regularly spaced thereon. In particular, the invention is directed to the provision of a method and apparatus for cutting zippers to a determined lengh from a continuous length of meshed adjacent chains of common zipper tape having bottom stops and sliders regularly positioned thereon.

In the past, equipment has been provided for cutting such continuous tapes, wherein microswitches were employed for electromechanically triggering pneumatic cutting action of the cutters. In previous arrangements of this type, problems were encountered in controlling the cutters to cut the desired specific lengths of the products of the individual zippers, and inconsistent cuts were thereby made on the ends of the tapes. In addition, it was difficult to control such apparatus to operate at very high speeds, which is of course desirable from a standpoint of increasing the production of the equipment.

The present invention is therefore directed to the provision of a method and apparatus for increasing the speed at which zippers or the like may be severed from a continuous tape, while insuring accuracy of the cutting operation.

Briefly stated, in accordance with the invention, the continuous zipper tape is fed by means of feed rollers to a preferably pneumatically operated cutter. The tape is directed substantially horizontally tangentially to the top of the feed roller by means of a guide bar, and detector means are provided along the guide bar upstream of the feed roller.

Specifically, a bottom stop detector, preferably in the form of a proximity detector, is provided upstream of the feed roller. A slide detector is provided between the stop detector and the feed roller, and preferably is comprised of a light source positioned above and to one side of the tape, and a photodetector aligned on the other side of the tape. Delay means, such a monostable multivibrator or a time delay relay is responsive to the detection of a passing slider for enabling the stop detector for a determined period. If a bottom slider is detected during this period, a second time delay circuit, which may be comprised of a monostable multivibrator or time delay relay, is energized, so that the control system for the cutter is actuated at a determined time following the detection of a bottom stop by the stop detector. In this arrangement, it is preferred that the cutter be pneumatically operated, and that the latter time delay means control a pneumatic valve for the pneumatically operated cutter.

In the system of the invention, it is apparent that the time delays above discussed are selected in accordance with the speed of the tape and the spacings between the detectors, feed rollers and cutters, so that the cutters sever the tape at the desired location.

In order that the invention will be more clearly understood, it will now be disclosed in greater detail with reference to the accompanying drawing, wherein.

Figure 1:
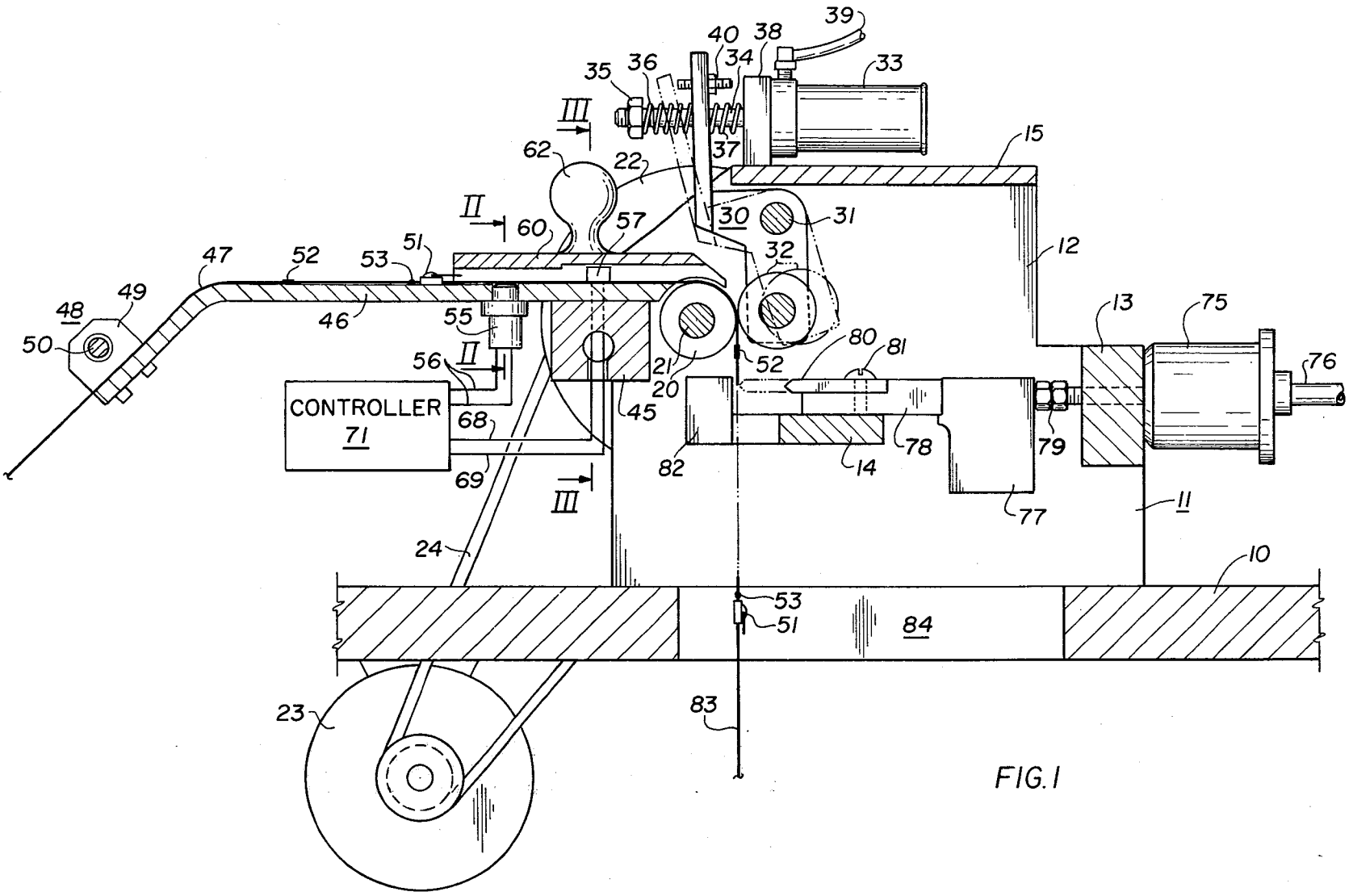
FIG. 1 is a partially cross section side view of a zipper tape cutter in accordance with the invention.

Referring now to the drawings, and more in particular to FIG. 1, therein is illustrated in simplified partially cross sectional view an automatic crimp cut machine in accordance with the invention. The apparatus is adapted for the cutting of zippers to specific measured lengths from a continuous length of meshed adjacent chains of common zipper tape.

The apparatus comprises a suitable support 10, such as a table, upon which is mounted a machine frame 11. The machine frame 11, in its simpliest form, may be considered to be comprised of a pair of parallel spaced apart plates 12, only one of which is illustrated in FIG. 1, the plates being joined by cross members 13 and 14, as well as by a top 15, for stability and to enable the mounting of various elements therein. The illustration of FIG. 1 is thus an illustration of the interior of the apparatus.

A drive roller 20 is mounted for rotation with a shaft 21 journaled for rotation in the side 12 of the machine frame. The shaft 21 extends through the illustrated plate 12, and a suitable conventional pulley 22 is mounted on this extension (not shown) of the shaft 21. A motor 23 which may, if desired, be mounted under the support 10 is coupled to the pulley 22 by a conventional belt 24, in order to enable rotating the drive roller 20.

A feed roll engaging lever 30 is pivotally mounted on a shaft 31 supported in the side plates 12 of the machine frame. A feed roller 32 is mounted for rotation on one end of the lever 30, and positioned to engage the feed roller 20.

In order to position the feed roller 32, an air or hydraulic cylinder 33 is mounted on the top 15 of the machine frame, the shaft 34 of the cylinder extending through an aperture in the other end of the lever 30. A nut 35 is threaded on the end of the shaft 34, and compression springs 36 and 37 are provided on opposite sides of the lever 30 surrounding the shaft 34, the spring 36 extending to the nut 35 and the spring 37 extending to the mounting support 38 of the cylinder 33, so that the cylinder may resiliently position on the drive roller 32.

In the illustrated position of the drive roller 32, no pressure has been applied to the feed conduit 39 of the cylinder 33 and the drive roller 32 is resiliently urged toward the drive roller 20. When pressure is applied to the conduit 39, the lever 30 is pivoted, to the position illustrated in dashed lines, so that the drive roller 32 is out of engagement with the drive roller 20.

An adjustable stop 40, positioned to engage the support 38, may be provided on the lever 30.

A hollow support 45 is affixed to the machine frame, extending between the side 12 and adjacent the feed roller 20. The hollow support 45 in turn supports a tape guide bar 46, which is mounted to direct a pair of zipper tapes 47 tangentially to the top of the feed roller 20. As illustrated in FIG. 1, the portion of the guide bar 46 adjacent the feed roller 20 is horizontal, while, if desired, the extremity of this guide bar may be curved, in order to direct the feed tape more conveniently from a supply source (not shown) of tape. A guide 48, consisting of a side plate 49 affixed to each side of the guide bar and a rod 50 extending therebetween and spaced from the guide bar, may be provided for directing tape on the guide bar.

The tape 47 is a continuous length of meshed adjacent chains of a common zipper tape, and this tape has thereon zipper sliders 51, bottom stops 52 and top stops 53. As it is conventional in apparatus of the type of the invention, means (not shown) are provided for sliding the sliders 51 adjacent the respective top stops 53, prior to crimping in the crimp cut machine. Such positioning is employed, in the apparatus of the present invention, in order to accurately locate the cuts to be made on the tape, as will be explained in greater detail in the following paragraphs.

A proximity detector 55, for example of the types PS - 1 of Namco Relay Co., is mounted in the tape guide bar 46 at a position spaced from the drive roller 20. This proximity detector provides an output on its output leads 56 in response to the passing thereover of any metallic element, such as the stops or sliders of the tape 47.

In addition, a photo detection system 57 is provided for detecting the passage of objects a predetermined distance above the guide bar 46, at a predetermined location of the guide bar between the proximity detector 55 and the drive roller 20. Specifically, the photo detection system 57 is positioned to detect the passage of sliders 51, which extend above the tapes 47, and not to detect either the top or bottom stops of the tape.

Figure 2:
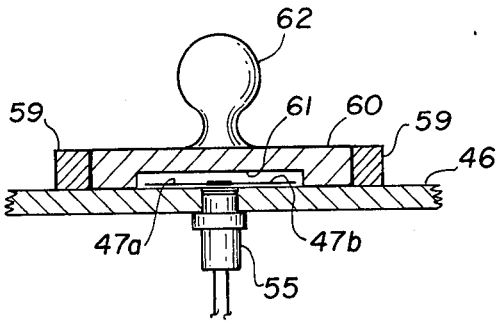
FIG. 2 is a cross sectional view of a portion of the apparatus of FIG. 1 taken along the lines II—II.

A tape guide plate 60 is provided, resting on top of the tape guide bar 46. As illustrated in FIG. 2, which is cross section of the tape guide bar 46 in the region of the proximity detector 55, the tape guide plate 60 has a longitudinally extending slot 61 in its lower surface, for guiding the two sides 47*a* and 47*b* of the tape 47. A suitable handle 62 is mounted by any conventional means to the top of the tape guide plate 60 in order to enable its ready removal for initially loading the machine with tape. In addition, guides 59, affixed to the guide bar 46 at its edges, serve to properly locate the position to the tape guide plate 60. FIG. 2 further illustrates that the sensing head of the proximity detector 55 is positioned adjacent the stops on the tape, as they pass through the machine.

Figure 3:
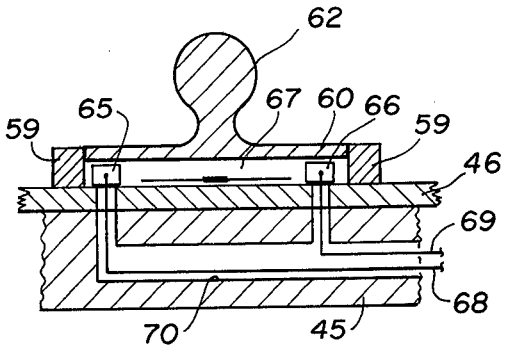
FIG. 3 is a cross sectional view of the portion of the apparatus of FIG. 1, taken along the lines III—III.

As illustrated in FIG. 3, the photo detection system is comprised of a light source 65 positioned on one side of the tape guide bar 46, to direct light transversely of the tape, toward a suitable conventional photo detector 66 mounted on top of the tape guide bar 46 on the other side of the tape. The photo detector 66 is positioned to detect passage of light through a transverse channel 67 in the tape guide plate 60, at a position above the tape, so that the photo detector may detect the passage of sliders 51 on the tape, but not the stops thereon.

The conductors 68 for energizing the light source 65, and the conductors 69 for conveying signals from the photo detector 66, may conveniently pass downwardly through suitable holes in the tape guide bar 46, and thence into the central hole 70 in the hollow support 45. As illustrated in FIG. 1, the conductors 56 from the proximity detector 55, the conductors 68 for energizing the light source, and the conductors 69 for receiving signals from the photo detector, may conveniently be led to a controller 71 to be discussed in more detail in the following paragraphs.

In order to enable severing of the tape, a further hydraulic or pneumatic cylinder 75 is mounted on the cross support 13 of the machine frame, this cylinder being supplied by way of a suitable conduit 76. The shaft of the cylinder 75 is coupled by way of a cutter spacer 77 to move a slide 78, the slide 78, for example, being guided on the cross support 14 of the machine frame. The coupling 79 of the cutter spacer 77 is readily accessible between the machine frame plates 12, for adjustment purposes. If desired, conventional guiding elements such as grooves or the like may be provided in the cross support 14, for more closely directing the sliding movement of the slider 78.

A cutter 80 is removably mounted on the slider 78, for example, by means of a screw 81, the cutter being directed to be moved toward an anvil 82 rigidly mounted to the cross support 14. The anvil face is positioned a short distance from the side of the vertical plane tangent to the drive roller 20 opposite the side thereof on which the cylinder 75 is mounted. As a consequence, tape driven by the drive roller 20 and moving downwardly therefrom may be severed by horizontal movement of the cutter 80 against the anvil 82. Tape severed from the continuous tape by means of the cutter 80, such as the tape section 83, thereby drops vertically from the cutter, for example, through an aperture 84 in the support 10, for collection in a suitable container or conveyer.

Figure 4:
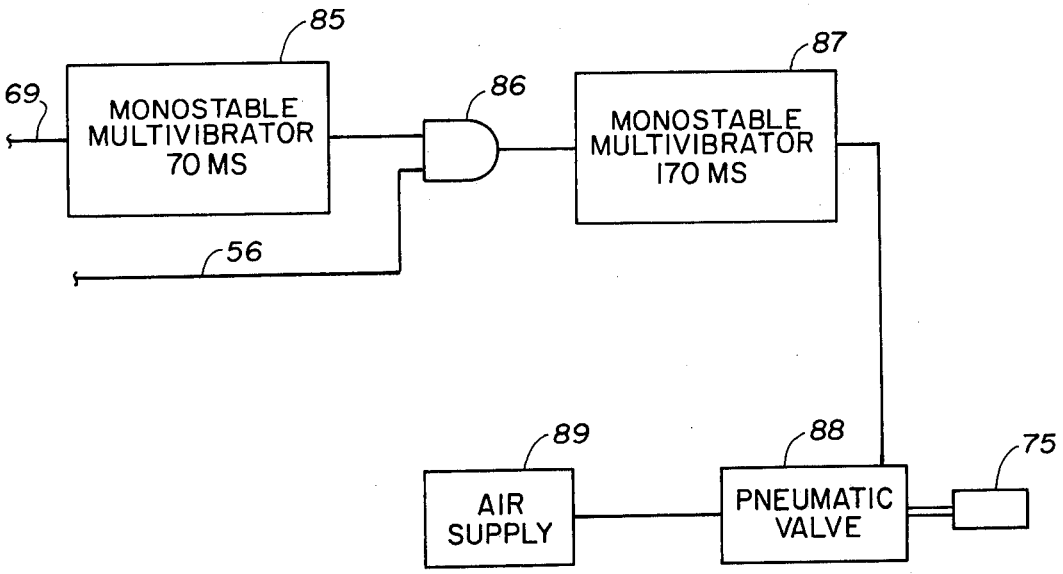
FIG. 4 is a simplified control diagram of a control system that may be employed in accordance with the invention.

One embodiment of a system for controlling the operation of the apparatus, is illustrated in FIG. 4. This FIGURE thereby shows elements that may be employed for the controller 71. In this arrangement, the signal leads 69 from the photo detector are applied to a delay circuit, such as a monostable multivibrator 85. The output of the monostable multivibrator, which may give a delay of, for example, 70 milliseconds, is applied as one input of an AND gate 86. The output of the proximity detector 55, on the lead 56, serves as the other input of the AND gate. The output of the AND gate energizes a further delay circuit, such as monostable multivibrator 87. This monostable multivibrator may delay the signal by, for example, 170 milliseconds. The delayed output of the multivibrator 87 is thence applied to operate a pneumatic valve 88, for momentarily applying pressurized air from an air supply 89 to the cylinder 75, by way of the conduit 76.

In operation, when the photo detector 66 detects the passage of the slider on a tape, it produces a signal which energizes the monostable multivibrator 85. As a consequence, the AND gate 86 is enabled for a time period of 70 milliseconds. If the proximity detector 55 detects the passage of a bottom stop 52 during this period, the signal will pass the AND gate 86, to trigger the monostable multivibrator 87. It is to be noted that the proximity detector 55 will not detect the occurrence of a top stop 53 during this period, due to the spacing between the proximity detector and the photo detector.

Upon the termination of the delay period of the energized monostable multivibrator 87, a signal is applied to the pneumatic valve system 88, to thereby enable energization of the pneumatic cylinder 75, and hence the rapid movement of the cutter 80 to sever a tape passing downwardly between the cutter 80 and the anvil 82. The severed section 85, will thence drop to a suitable conveyer or container, as illustrated in FIG. 1.

It is of course apparent that the delays of the multivibrators as discussed with reference to FIG. 4 are determined by the speed of the drive rollers, as well as the spacings of the various elements, so that the point at which the tape is to be severed is accurately positioned in front of the cutter 80 at the correct time. It is to be noted that if there was no bottom stop on the continuous tape, for example if the bottom stop was left off during an earlier production step, then the cutter will not be activated, and a new cutting cycle will start when the next slider passes the photoelectric detector.

The drive roller 20 has been described as a single roller, although it will be apparent that this roller may constitute a pair of rollers mounted on the shaft 21, and spaced apart to enable the passage of the zipper elements therebetween. In other words, two rollers may be provided so that only the tape is driven. The drive roller 32 may similarly constitute a pair of rollers. In addition, the rollers 20 and 32 are preferably knurled rollers.

As above discussed, the tape is driven by the drive rollers 20 and 32 when the pneumatic or hydraulic cylinder 33 is not energized. In order to enable loading of the device, however, the drive roller 32 must be moved away from the drive roller 20. For this purpose, pressurized fluid is applied to the conduit 39, to effect the rotation of the lever 30, and hence the moving of the drive roller 32 away from the drive roller 20. As a consequence, when the tape guide plate 60 is removed manually from the top of the tape guide bar 46, the end of a new continuous tape may be readily loaded into the apparatus. The control for the cylinder 33 may be either automatic or manual, and is not material to the present invention.

While, for the sake of simplicity, the delay devices have been illustrated and described as monostable multi-vibrators, it will be obvious that conventional time delay may be employed for this purpose. It is further noted that the pneumatic valve 88 may be, for example, a Foret valve Model No. 1061, as disclosed, for example, in U.S. Letters Pat. No. 3,378,121. Such devices have proven quite satisfactory in the apparatus in accordance with the invention, although it will be apparent that the invention is not limited to the use of such devices.

While the invention has been disclosed and described with reference to a single embodiment thereof, it will be apparent that variations and modifications may be made therein, and it is therefore intended in the following claims to cover each such variation and modification as falls within the true spirit and scope of the invention.

What is claimed is:

1. An apparatus for cutting continuous tapes having distinguishable locations of first and second types regularly appearing thereon, comprising cutter means, control means for operating said cutter means, means for advancing said tape toward said cutter means at a determinable rate, first detecting means positioned to detect the passage of a location of said first type passed a first given position, second detecting means positioned to detect the passage of a location of the second type passed a second given position, first delay means responsive to detection of a location of said first type for enabling detection of a location of said second type for a second determined time period, and second delay means responsive to the detection of a location of said second type within said first determined period for energizing said control means a second predetermined time period after the detection of said location of said second type.

2. An apparatus for cutting zippers to a determined length from a continuous length of meshed adjacent chains of common zipper tape having bottom stops and slides positioned thereon; said apparatus comprising cutter means, feed roller means directing said common zipper tape to said cutter means, stop detector means positioned to detect the passage of said bottom stops at a determined position upstream of said cutter means, slide detector means responsive to passage of said slides at a second position upstream of said cutter means and connected to enable said stop detector means only during a first determined period following detection of a slide, and time delay means responsive to detection of a bottom stop by said stop detector means for activating said cutter means a determined time following detection of a bottom stop.

3. The apparatus of claim 2 wherein said stop detector means comprises proximity detector means positioned upstream of said feed roller means, and said slide detector means comprises photoelectric detector means positioned between said stop detector means and said feed roller means.

4. The apparatus of claim 2 further comprising a guide bar positioned to direct said common zipper tape tangentially to said feed roller means, said stop detector means and slide detector means being positioned along said guide bar upstream of said feed roller means.

5. The apparatus of claim 4 wherein said feed roller means directs said tape downwardly, and said cutter means is positioned below said feed roller means.

6. The apparatus of claim 5 wherein said cutter means comprises a fixed anvil disposed on one side of said tape beneath said feed roller means, and a pneumatically operated cutter positioned on the other side of said tape below said feed roller means.

7. The apparatus of claim 2 wherein said feed roller means comprises a first feed roller having a substantially horizontal axis, means for driving said first feed roller, and a second feed roller resiliently urged toward said first feed roller, and further comprising guide bar means positioned to direct said tape substantially horizontally and tangentially to the top of said first feed roller, said stop detector and slide detector means being positioned along said guide bar upstream of said first feed roller, said second feed roller being resiliently urged toward the side of said first feed roller to direct said tape downwardly, said cutter means being positioned beneath said first and second feed rollers.

8. The apparatus of claim 7 comprising lever means, said second feed roller being mounted on said lever means, means resiliently biasing said lever means to resiliently urge said second roller toward said first roller, and pneumatic means upwardly coupled to said lever means for urging said second roller away from said first roller.

9. The apparatus of claim 2 further comprising a guide bar extending substantially horizontally to direct said tape tangentially to the top of said feed roller means, said stop detector means comprising a proximity detector extending through said guide bar upstream of said feed roller means, said slide detector means comprising a source of light positioned above said guide bar means on one side of said tape, and a photodetector aligned with said light source on the other side of said tape.

10. The apparatus of claim 9 wherein said slide detector means is positioned between the stop detector means and said feed roller means, and further comprising a guide plate removably positioned on said guide bar above said stop detector means and slide detector means and having a longitudinally extending groove in its lower surface through which said tape passes.

11. A method for cutting zippers to a determined length from a continuous length of meshed adjacent chains of common zipper tape having bottom stops and sliders regularly positioned thereon, said method comprising directing said common zipper tape to a cutter at a determined rate, detecting passage of a slider at a first position of said cutter, detecting passage of a bottom stop at a second position upstream of said cutter that occurs within a given time following said detection of a slider, and operating said cutter to sever said tape a determined time following said detection of a bottom stop.

12. The method of claim 11 wherein said common zipper tape has top stops further comprising positioning said sliders against said top stops prior to directing said tape to said cutter.

* * * * *